US010442578B2

(12) United States Patent
Thompson et al.

(10) Patent No.: US 10,442,578 B2
(45) Date of Patent: Oct. 15, 2019

(54) CHILD RESISTANT SLIDER, ZIPPER CLOSURE SYSTEM USING SLIDER, AND METHODS OF USE

(71) Applicant: Reynolds Presto Products Inc., Lake Forest, IL (US)

(72) Inventors: Gregg Thompson, Canandaigua, NY (US); John Athans, Victor, NY (US)

(73) Assignee: Reynolds Presto Products Inc., Lake Forest, IL (US)

( * ) Notice: Subject to any disclaimer, the term of this patent is extended or adjusted under 35 U.S.C. 154(b) by 0 days.

(21) Appl. No.: 15/826,079

(22) Filed: Nov. 29, 2017

(65) Prior Publication Data

US 2019/0161243 A1 May 30, 2019

(51) Int. Cl.
*B65D 33/00* (2006.01)
*B65D 33/25* (2006.01)

(52) U.S. Cl.
CPC ..... *B65D 33/2591* (2013.01)

(58) Field of Classification Search
CPC ..... B65D 33/2591
USPC ..... 383/64
See application file for complete search history.

(56) References Cited

U.S. PATENT DOCUMENTS 5,007,143 A 4/1991 Herrington
5,088,971 A 2/1992 Herrington
5,131,121 A 7/1992 Herrington, Jr. et al.
5,161,286 A 11/1992 Herrington, Jr. et al.
5,448,807 A 9/1995 Herrington, Jr.
5,681,115 A 10/1997 Diederich et al.
5,711,609 A 1/1998 Simonsen
5,775,812 A 7/1998 St. Phillips et al.
5,833,971 A 11/1998 Baldwin
6,036,364 A 3/2000 Heuvel
6,287,000 B1 9/2001 Buchman
6,361,213 B2 3/2002 Randall
6,376,035 B1 4/2002 Dobreski et al.
6,611,996 B2 * 9/2003 Blythe ..... A44B 19/267 24/399
6,789,947 B1 9/2004 Kasai
6,846,108 B2 1/2005 Buchman
7,255,477 B2 8/2007 Arnell
7,416,340 B2 8/2008 Schneider
7,524,110 B2 4/2009 Anzini et al.
(Continued)

FOREIGN PATENT DOCUMENTS

EP 1312278 A1 5/2003
EP 1391390 A1 2/2004
(Continued)

OTHER PUBLICATIONS

International Search Report and Written Opinion for Application No. PCT/US2018/062869 dated Feb. 6, 2019, 16 pages.

*Primary Examiner* — Peter N Helvey
(74) *Attorney, Agent, or Firm* — Merchant & Gould P.C.

(57) ABSTRACT

A child resistant slider includes a top member and a pair of spaced legs depending from the top member. At least a first leg of the spaced legs has a first tang projecting laterally away from a remaining portion of the first leg and a remaining portion of the slider. The first tang has a separator plow. The tang can be movable to move the first plow into a position to separate interlocked male and female tracks of a zipper closure. In other examples, both legs include a projecting tang having a separator plow.

18 Claims, 11 Drawing Sheets

(56) References Cited

U.S. PATENT DOCUMENTS

| | | | | |
|---|---|---|---|---|
| 7,543,362 | B2 | 6/2009 | Olechowski | |
| 7,670,052 | B2 | 3/2010 | Chaturvedi | |
| 7,797,802 | B2 | 9/2010 | Ackerman | |
| 7,921,534 | B2 | 4/2011 | Patel et al. | |
| 7,946,003 | B2 | 5/2011 | Sprague et al. | |
| 9,505,531 | B2 | 11/2016 | Chapek | |
| 9,554,628 | B2 | 1/2017 | Chapek | |
| 2002/0064320 | A1 | 5/2002 | May | |
| 2002/0064321 | A1* | 5/2002 | Schreiter | B65D 33/2591 383/64 |
| 2003/0000050 | A1 | 1/2003 | Blythe | |
| 2003/0014848 | A1 | 1/2003 | LaRue et al. | |
| 2003/0138171 | A1 | 7/2003 | Kikuchi | |
| 2003/0185468 | A1* | 10/2003 | Keith | B65D 33/007 383/9 |
| 2004/0037477 | A1* | 2/2004 | Buchman | B65D 33/2591 383/64 |
| 2004/0083782 | A1 | 5/2004 | Lantz | |
| 2005/0257351 | A1 | 11/2005 | Pitts et al. | |
| 2006/0008186 | A1 | 1/2006 | Kusz | |
| 2006/0133700 | A1 | 6/2006 | Cappel | |
| 2006/0168779 | A1 | 8/2006 | Chaturvedi | |
| 2006/0269171 | A1* | 11/2006 | Turvey | A44B 19/267 383/64 |
| 2007/0071367 | A1 | 3/2007 | Buchman | |
| 2009/0139067 | A1 | 6/2009 | Ackerman | |
| 2010/0011545 | A1 | 1/2010 | Anzini | |
| 2013/0287322 | A1* | 10/2013 | Gong | B65D 33/2591 383/64 |
| 2014/0259559 | A1 | 9/2014 | VanLoocke | |
| 2014/0298757 | A1 | 10/2014 | Chapek | |

FOREIGN PATENT DOCUMENTS

| | | | |
|---|---|---|---|
| EP | 1661479 | B1 | 6/2010 |
| FR | 2770493 | A1 | 5/1999 |
| WO | 2009112078 | A1 | 9/2009 |
| WO | 2010008917 | A1 | 1/2010 |
| WO | 2010029455 | A1 | 3/2010 |

* cited by examiner

CHILD RESISTANT SLIDER, ZIPPER CLOSURE SYSTEM USING SLIDER, AND METHODS OF USE

TECHNICAL FIELD

This disclosure relates to a slider for a recloseable zipper closure useable with a bag or pouch. More particularly, this disclosure relates to a child resistant slider useable with a recloseable zipper closure for a bag or pouch.

BACKGROUND

Manufacturers of household products have increasingly replaced rigid packages with recloseable flexible packages due to the advantages offered by these flexible packages that include: less packaging material, lower package cost, reduced storage space, and lower shipping costs.

Once recloseable flexible packages containing household products are purchased, they are typically stored in a convenient household location where they are retrieved, opened, and reclosed until the contents are depleted. Opening and reclosing of these packages is easy for both adults and children. If these packages contain potentially harmful products and are accessible to young children, this presents a risk to them. As a result, there is a need to provide for a large-scale closure and method to increase the difficulty for children to open the bag and yet provide adequate means for adults and senior citizens to open the bag.

SUMMARY

In general, a child resistant slider is provided that improves the prior art.

In one aspect, a child resistant slider zipper closure system is provided. The system includes a recloseable zipper closure with a male track and a female track having complementary profiles for interlocking and unlocking. A notch is located in the male and female tracks, and the notch is spaced a distance from an end of the zipper closure. A slider is slidably located on the zipper closure. The slider includes a top member and a pair of spaced legs depending from the top member. The spaced legs define an open volume therebetween to allow for passage of the tracks therethrough and with the legs straddling the tracks. At least a first leg of the spaced legs has a first tang projecting laterally away from a remaining portion of the first leg and a remaining portion of the slider. The first tang has a first separator plow on a portion thereof. The first tang is selectively movable to locate the first plow in the open volume between the legs to separate the male and female tracks as the slider is moved in an opening direction along the zipper closure.

The closure system may further have internal surfaces spaced sufficiently close together to engage the male and female tracks into interlocking relationship as the slider is moved in a closing direction along the tracks.

In example embodiments, the first tang has a fixed end secured to a remaining portion of the first leg and a free deflectable end. The first plow is at the free end.

In some example embodiments, the second leg of the spaced legs has a second tang projecting laterally away from a remaining portion of the second leg and a remaining portion of the slider. The second tang has a second separator plow on a portion thereof. Both the first tang and second tang are selectively movable to locate the first plow and second plow adjacent each other in the open volume between the legs, wherein the adjacent first plow and second plow are shaped in an adjacent orientation to separate the male and female tracks as the slider is moved in an opening direction along the zipper closure.

In some embodiments, the second tang has a fixed end secured to a remaining portion of the second leg and a free deflectable end. The second plow is at the free end of the second tang.

In example implementations, the internal surfaces that are spaced sufficiently close together to engage the male and female tracks into interlocking relationship comprise internal surfaces of the legs.

An additional aspect is directed to a flexible package using the child resistant zipper closure system as variously characterized above. The package includes first and second panels each having a top forming a mouth, a bottom, and first and second opposing sides. The first and second panels are joined to each other along their respective bottoms, their respective first opposing sides, and their respective second opposing sides. One of the tracks is in proximity to the top of the first panel, and the other of the tracks is in proximity to the top of the second panel.

An additional aspect is directed to a slider for a zipper closure having a male track and a female track with complementary profiles for interlocking and unlocking. The slider includes a top member, and a pair of spaced legs depending from the top member. The spaced legs define an open volume therebetween to allow for passage of the tracks therethrough and with the legs straddling the tracks. Internal surfaces are spaced sufficiently close together to press the profiles into interlocking relationship as the slider is moved in a closing direction along the zipper closure. At least a first tang is extending from a first leg of the spaced legs and is spaced away from a remaining portion of the first leg and a remaining portion of the slider. The first tang is constructed and arranged to flex relative to the first leg about a pivot axis in a direction toward and away from the open volume. A first separator plow extends from the first tang and moves toward and away from the open volume with flexing of the first tang. The first separator plow is selectively movable into a position to remain between the male track and female track and separate the interlocking profiles as the slider is moved in an opening direction along the zipper closure.

In example embodiments, the first tang has a fixed end secured to a remaining portion of the first leg and a free deflectable end. The first plow is at the free end.

In some example embodiments, a second leg of the spaced legs has a second tang projecting laterally away from a remaining portion of the second leg and a remaining portion of the slider. The second tang has a second separator plow on a portion thereof. Both the first tang and second tang are selectively movable to locate the first plow and second plow adjacent each other into the open volume between the legs to separate the interlocking profiles as the slider is moved in an opening directions along the zipper closure.

In some example embodiments, both the first tang and second tang are selectively movable to locate the first plow and second plow against each other into the open volume between the legs to separate the interlocking profiles as the slider is moved in an opening direction along the zipper closure.

In many example embodiments, the second tang has a fixed end secured to a remaining portion of the second leg and a free deflectable end. The second plow is at the free end of the second tang.

In one or more example embodiments, the slider is molded as a single piece.

Some embodiments include the legs comprising the internal surfaces.

In a further aspect, a method of operating a zippered bag having an openable and recloseable mouth is provided. The method includes a step of providing a zippered bag having first and second panels each having a top forming the mouth, a bottom, and first and second opposing sides; the first and second panels being joined to each other along their respective bottoms, their respective first opposing sides, and their respective second opposing sides; a recloseable zipper closure including a male track and a female track with complementary profiles for interlocking and unlocking; one profile being in proximity to the top of the first panel, and the other profile being in proximity to the top of the second panel; the complementary profiles interlocking to close the mouth and unlocking to open the mouth; the zipper closure including a notch spaced from the first side; a slider located on the zipper closure; and the slider having a top member and a pair of spaced legs depending from the top member. The method includes a step of opening the mouth by moving the slider to the notch; squeezing the spaced legs inwardly toward each other to position a separator plow on at least one of the legs between the male track and female track; and while the plow is between the male track and female track, moving the slider in an opening direction along the zipper closure to result in separation of the interlocking profiles.

In example methods, the step of squeezing the spaced legs includes moving a flexible tang projecting laterally away from a first of the legs and a remaining portion of the slider to position the separator plow between the male track and female track.

In example methods, the step of squeezing the spaced legs includes moving a pair of flexible tangs, each flexible tang having a separator plow, each flexible tang projecting laterally away from a respective one of the legs and a remaining portion of the slider, to position the separator plows between the male track and female track.

In many example methods, the step of positioning the separator plows includes positioning the separator plows adjacent and against each other between the male track and female track.

A variety of examples of desirable product features or methods are set forth in the description that follows, and in part, will be apparent from the description, or maybe learned by practicing various aspects of this disclosure. The aspects of this disclosure may relate to individual features as well as combinations of features. It is to be understood that both the foregoing general description and the following detailed description are explanatory only, and are not restrictive of the claimed invention.

DETAILED DESCRIPTION

A. Example Package and Closure

Figure 1:
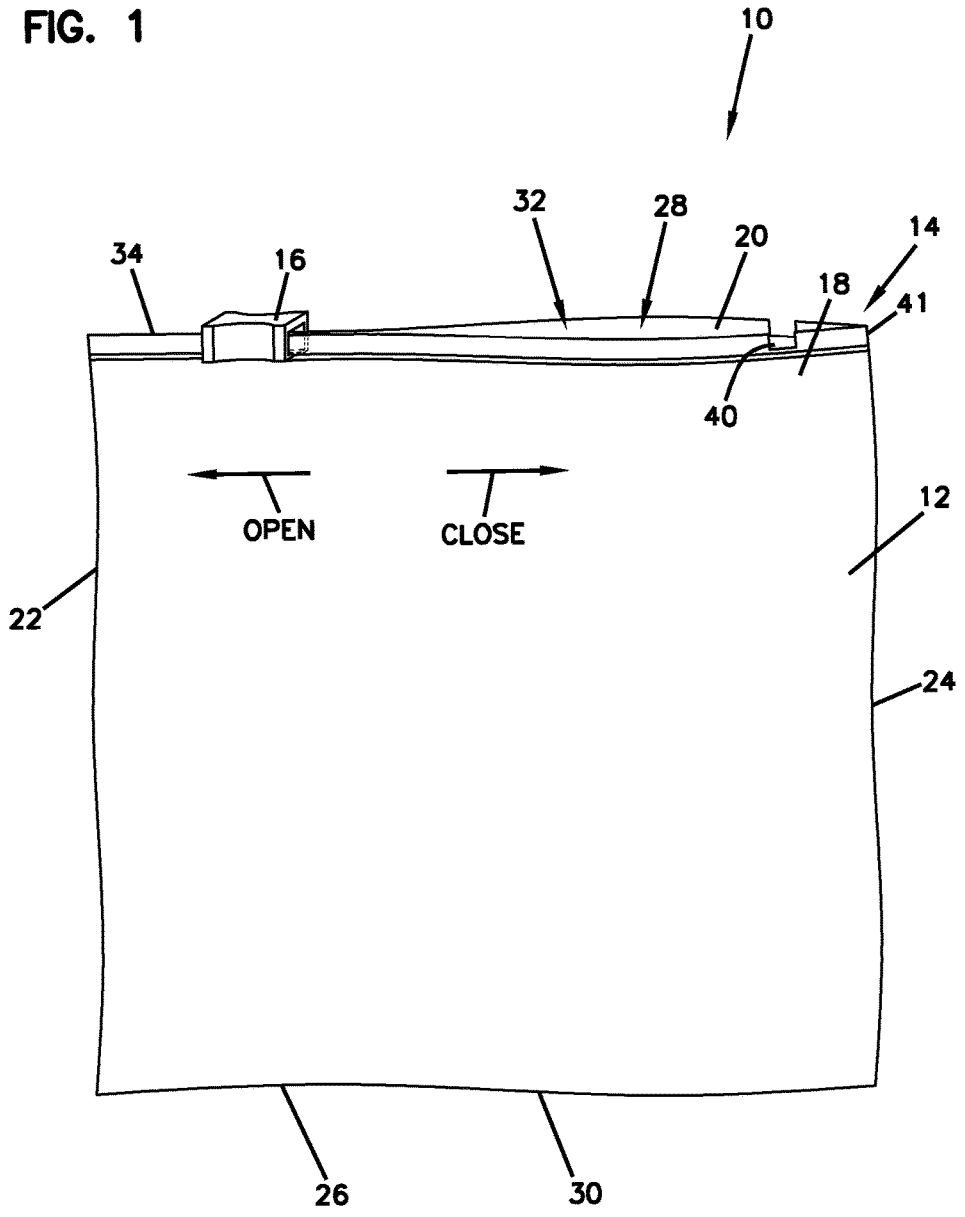
FIG. 1 is a perspective view of an example flexible, recloseable pouch or package with a child resistant slider, constructed in accordance with principles of this disclosure.

In FIG. 1 is one example embodiment of a packaging arrangement in the form of a recloseable pouch or bag, including a flexible package 10. For example, the package 10 can be a polymeric package, such as a plastic bag 12 having a recloseable closure in the form of a plastic zipper closure 14. Also shown is a slider 16 for opening and closing the zipper closure 14. The slider 16 is child resistant, as described further below. Preferably, the sliders 16 described herein are molded as a single piece of plastic, although many alternatives are possible.

The package 10 can be many different arrangements. In the example shown, the package 10 includes first and second opposed panel sections 18, 20, typically made from a flexible, polymeric, plastic film. Some manufacturing techniques heat seal together the first and second panel sections 18, 20 along two side edges 22, 24 and to meet at a fold line 26 in order to form a three-edged containment section for a product within an interior 28 of the package 10.

In the embodiment shown, the fold line 26 comprises the bottom edge 30 of the package 10. Access is provided to the interior 28 of the package 10 through an open mouth 32 along a top edge 34 of the package 10. In this embodiment, the mouth 32 extends the width of the package 10 between the side edges 22, 24. The mouth 32, in this embodiment, is opposite of the bottom edge 30. In other embodiments, the panel sections 18, 20 can be heat sealed together along the side edges 22, 24, as well as the bottom edge 30. Many alternatives are possible.

The zipper closure 14 is illustrated in the FIG. 1 embodiment at the mouth 32 along the top edge 34. In other embodiments, the zipper closure could be positioned on the package 10 at a location different from the mouth 32, depending upon the application needs of the package 10.

Figure 20:
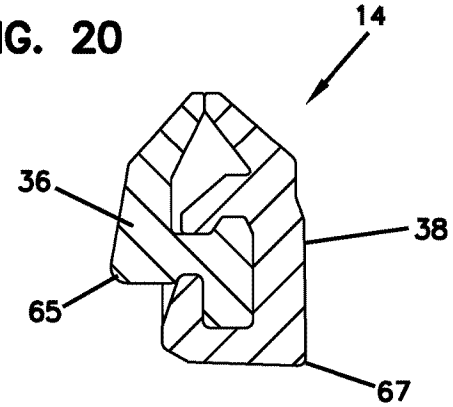
FIG. 20 is a cross-sectional view of one example embodiment of a zipper closure useable with any of the sliders of the previous FIGS.
Figure 10:
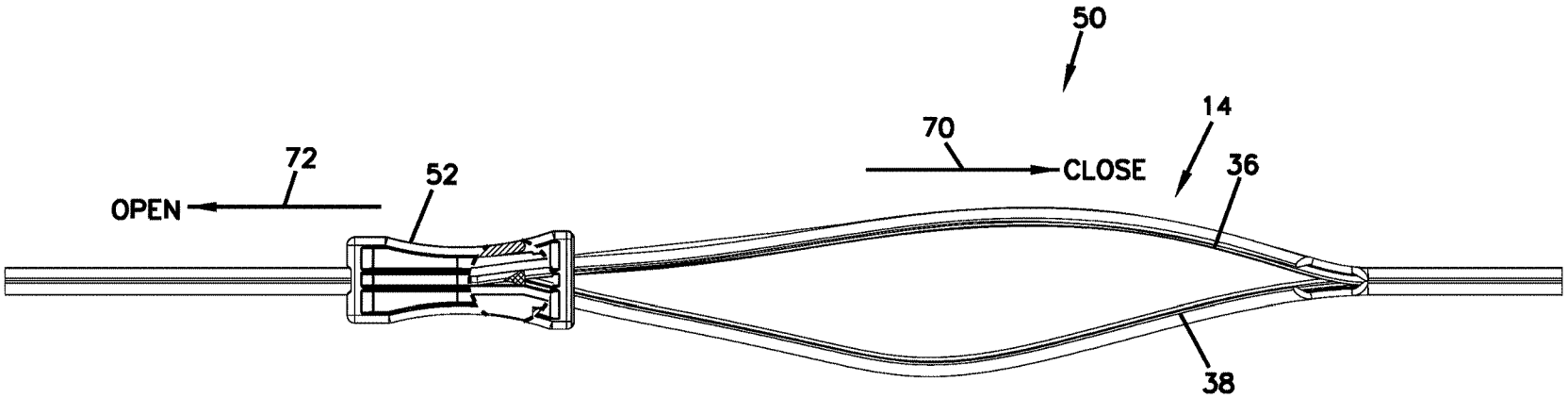
FIG. 10 is a top view of the slider zipper closure system of FIG. 2, with a portion of the slider broken away to show how the slider is used to separate interlocking tracks of the zipper closure.
Figure 11:
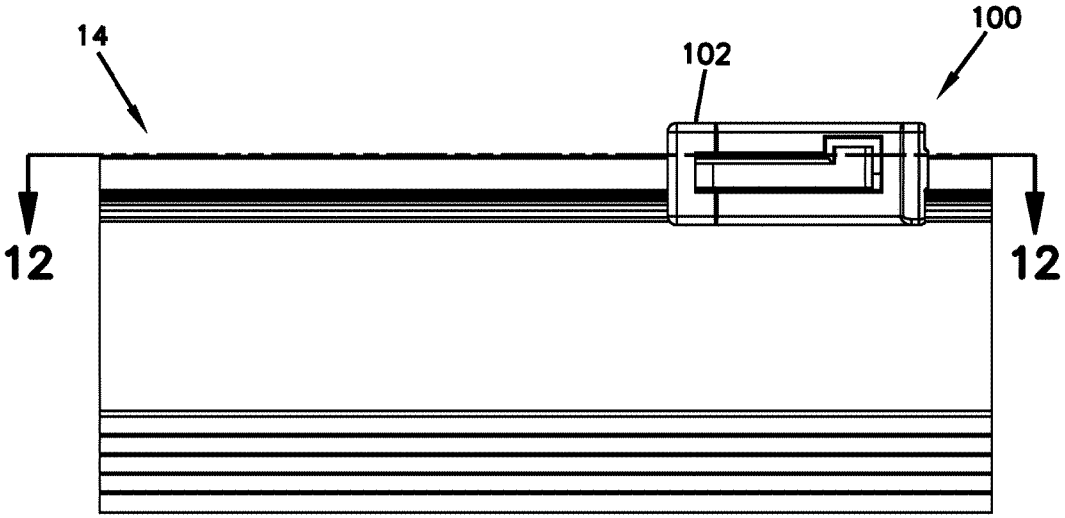
FIG. 11 is a side elevational view of another embodiment of a child resistant slider zipper closure system, constructed in accordance with principles of this disclosure.
Figure 12:
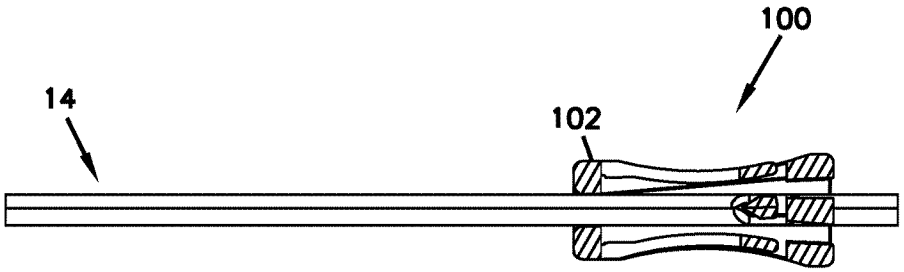
FIG. 12 is a cross-sectional view of the system of FIG. 11, the cross section being taken along the line 12-12 of FIG. 11.
Figure 14:
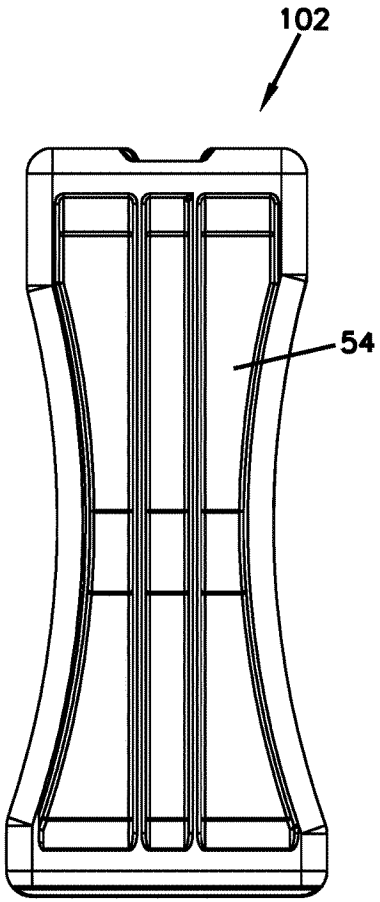
FIG. 14 is a top view of the slider used in the system of FIG. 11, the tangs not being visible as they are inwardly deflected.
Figure 19:
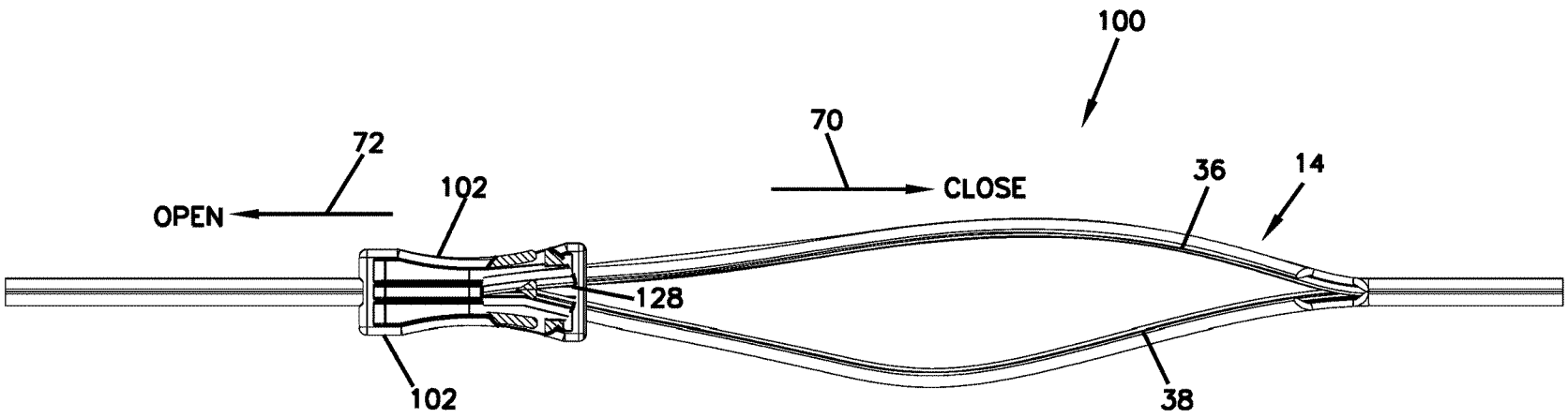
FIG. 19 is a top view of the slider zipper closure system of FIG. 11, with a portion of the slider broken away to illustrate the slider separating the interlocking profiles of the zipper closure.

The zipper closure 14 may be many different types of zipper closures. In one example, the zipper closure 14 has complementary profiles for interlocking and unlocking including a male track 36 (FIGS. 10, 19, and 20) and a female track 38 (FIGS. 10, 19, and 20). The male and female tracks 36, 38 have complementary cross-sectional shapes and are closed by pressing together. Usable example engageable profiles are described in U.S. Pat. No. 5,442,838, or 5,007,143, each of which is incorporated herein by reference. Many alternatives are possible.

The zipper closure 14 includes a notch 40. The notch 40 will typically be spaced a distance from the side 24 of the package 10. The notch 40 is also typically spaced a distance from an end 41 of the zipper closure 14. As will be described further below, the notch 40 is provided to allow the user of the package 10 to position a portion of the slider 16 and allow the interlocked tracks 36, 38 to be separated.

B. Example Embodiment of FIGS. 2-10 and 20

Figure 2:
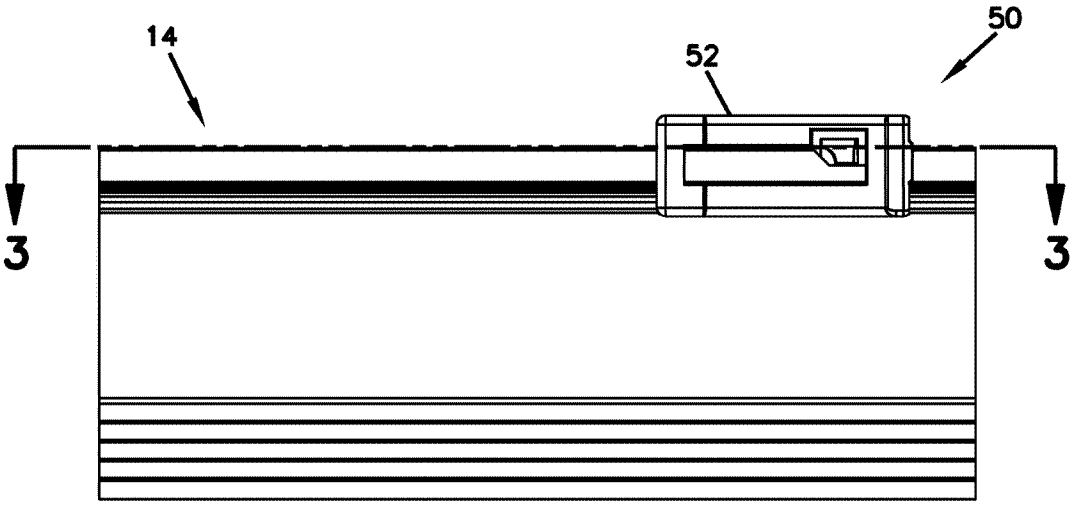
FIG. 2 is a side elevational view of a first embodiment of a child resistant slider zipper closure system, constructed in accordance with principles of this disclosure.
Figure 3:
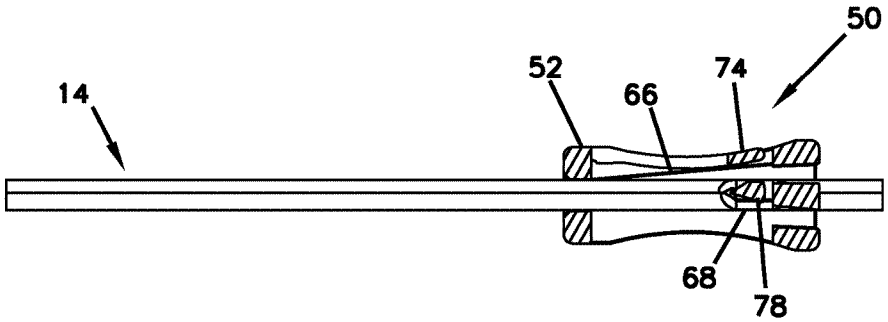
FIG. 3 is a cross-sectional view of the slider zipper closure system of FIG. 2, the cross section being taken along the line 3-3 of FIG. 2.

A first embodiment of a child resistant slider closure system is shown in FIGS. 2, 3, and 10 at 50. A first embodiment of the slider 16 is shown used with system 50 at 52. The slider 52 is slidably located on the zipper closure 14. The slider 52 includes a top member 54 (FIGS. 4,5,8,9). A pair of spaced legs in the form of a first leg 56 and second leg 58 depends from the top member 54. The spaced legs 56, 58 define an open volume 60 (FIGS. 8 and 9) therebetween. The open volume 60 allows for passage of the tracks 36, 38 therethrough with the legs 56, 58 straddling the tracks 36, 38 (FIG. 10).

Figure 9:
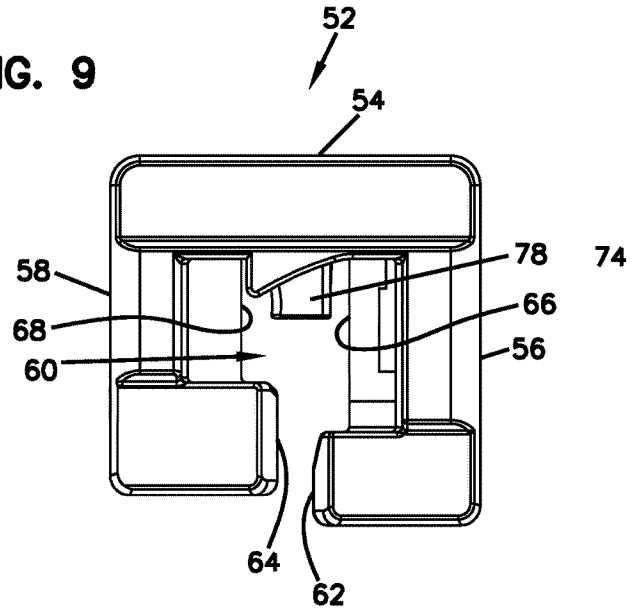
FIG. 9 is an end view of the slider of FIG. 5.
Figure 8:
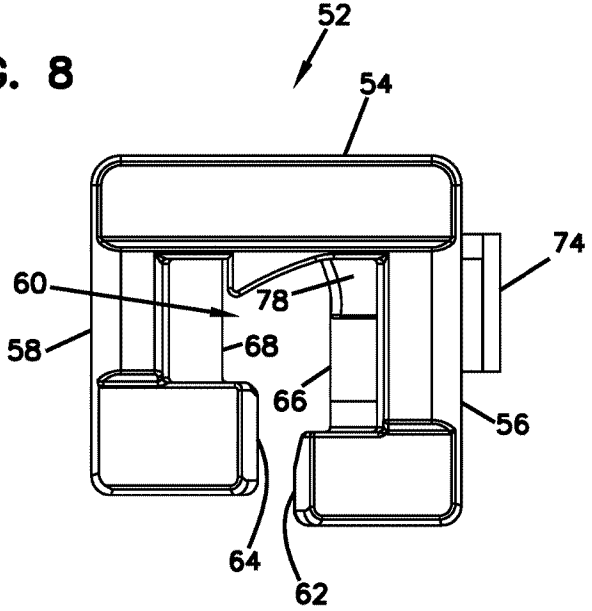
FIG. 8 is an end view of the slider of FIG. 4.

In FIGS. 8 and 9 it can be seen how the first and second legs 56, 58 each has an opposing hook 62, 64, which are inwardly facing each other. The hooks, 62, 64 may be used to engage bottom shoulders 65, 67 (FIG. 20) of the tracks 36, 38. In this manner, when the slider 52 is operably mounted on the zipper closure 14, the top member 54 glides along the top edge 34 while the legs, 56, 58 straddle the tracks 36, 38 and the hooks 62, 64 can engage bottom shoulders of the tracks 36, 38.

The slider 52 includes internal surfaces 66, 68 (FIG. 3) spaced sufficiently close together to engage the male track 36 and female track 38 into interlocking relationship as the slider 52 is moved in a closing direction 70 (FIG. 10) along the tracks 36, 38. While alternatives are possible, in the illustrated embodiment, each of the first leg 56 and second leg 58 has the internal surfaces 66, 68. When the slider 52 is moved in an opening direction 72 (FIG. 10), the slider 52 will unlock the interlocked male and female tracks 36, 38, provided the child resistant features have been overcome, as explained further below.

When the term "child resistant" is used to refer to the closure systems or the slider herein, it is meant that there are features to inhibit a child from easily being able to open the zipper closure 14. For example, in a system that is not child resistant, the child would merely need to slide the slider 52 along the zipper closure 14. By being child resistant, there are additional steps that must be taken in order to unlock the profiles, steps which would be difficult for a child to accomplish. Examples of child resistant features are now further described.

In accordance with principles of this disclosure, at least one of the legs of the first leg 56 and second leg 58 has a child resistant feature constructed and arranged to inhibit a child from easily being able to open the zipper closure 14. In this embodiment, in the example shown, the first leg 56 has a first tab or tang 74 projecting laterally away from a remaining portion of the first leg 56 and a remaining portion of the slider 52. By "projecting laterally", it is meant that the first tang 74 is angled at a non-zero angle away from a central longitudinal axis 76 (FIG. 4) contained within a plane bisecting the slider between the legs 56, 58. The first tang 74 projects laterally from the slider 52 along a plane that is non-parallel to the plane containing the central longitudinal axis 76. As can be seen in the view in FIG. 8, the first tang 74 extends from a remaining portion of the first leg 56, and it extends in a direction away from the second leg 58 and a remaining portion of the slider 52.

The first tang 74 has a first separator plow 78 (FIGS. 6 and 7) on a portion thereof. The first plow 78 is constructed and arranged, in some embodiments, to separate the male and female tracks 36, 38 when the first separator plow 78 is positioned between the tracks 36, 38, and the slider 52 is moved in an opening direction along the zipper closure 14.

Figure 5:
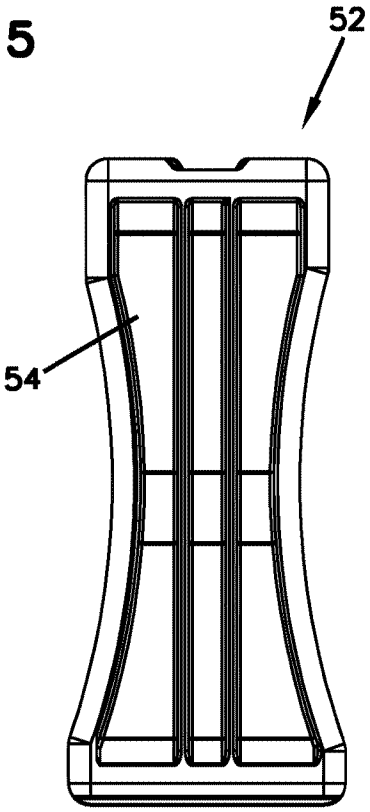
FIG. 5 is another top view of the slider used in the system of FIG. 2, the projecting tang not being visible, as it is inwardly deflected.
Figure 4:
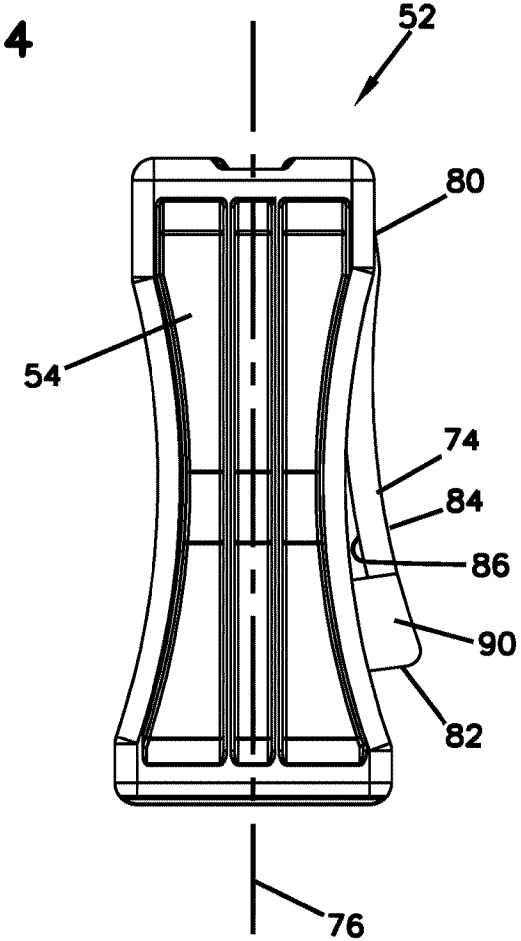
FIG. 4 is a top view of the slider used with the system of FIG. 2, a projecting tang being visible.
Figure 6:
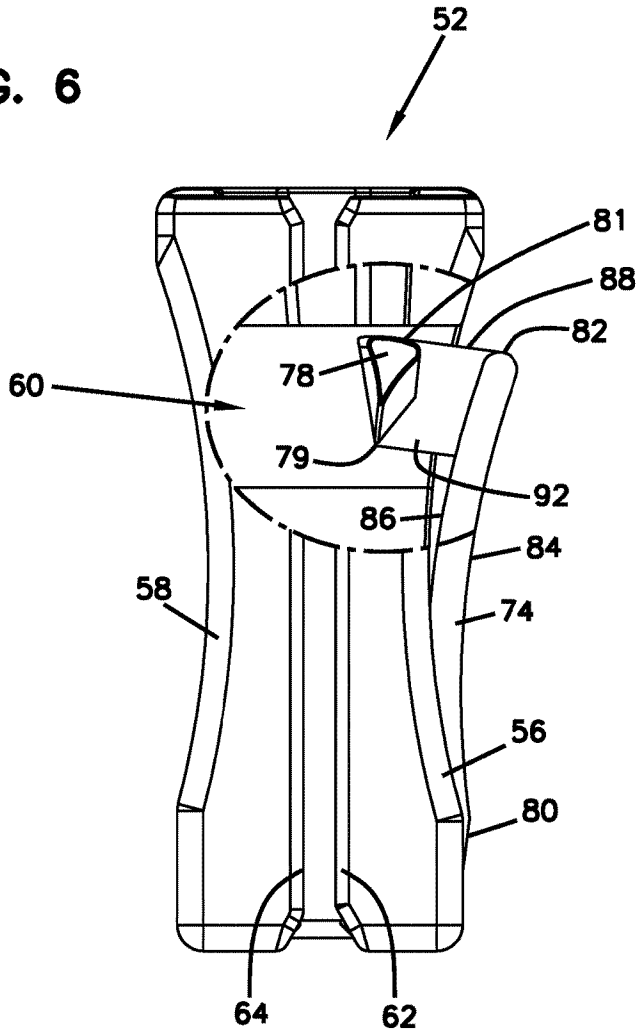
FIG. 6 is a bottom view of the slider of FIG. 4, with a portion broken away to show further details of the projecting tang.

In reference now to FIGS. 4-7, views of the first tang 74 and the first separator plow 78 are shown. In FIGS. 4 and 6, the first tang 74 can be seen as having a fixed end 80 secured to a remaining portion of the first leg 56 and an opposite, free deflectable end 82. The first tang 74 has an external side 84, forming an outside surface of the slider 52, and an opposite internal side 86 facing the open volume 60.

Figure 7:
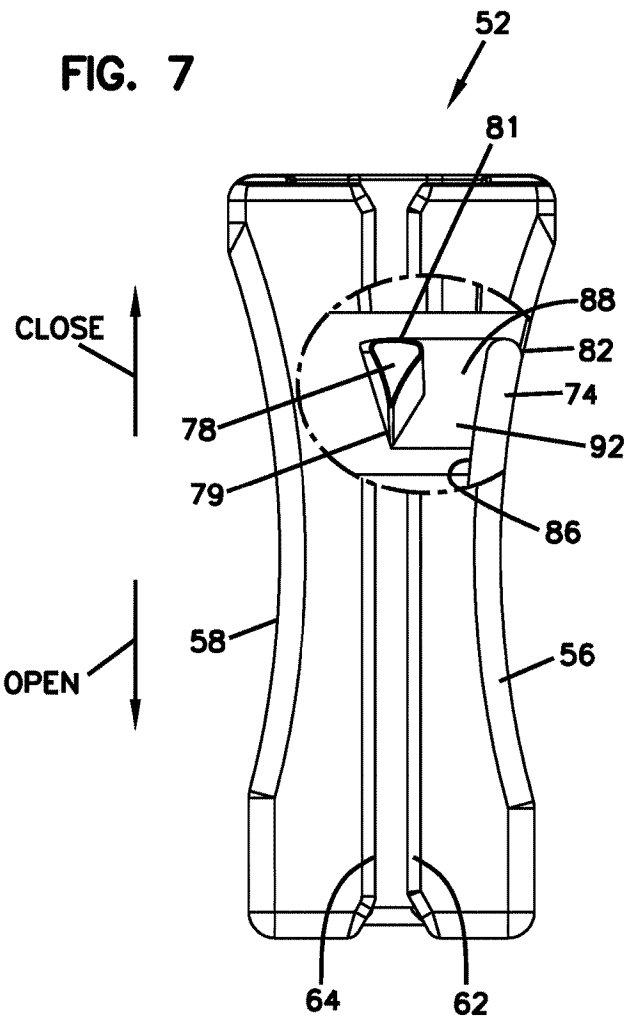
FIG. 7 is a bottom view of the slider of FIG. 5, with a portion broken away to show further details of the tang, as being inwardly deflected.

The first separator plow 78 is located, in this embodiment, at the free end 82. Many embodiments are possible. In this embodiment, a first foot 88 extends inwardly in a direction toward the volume 60 and second leg 58 from the internal side 86 at the free end 82. The first foot 88 has a top side 90 (FIG. 4) and an opposite bottom side 92 (FIGS. 6 and 7). The top side 90 is facing and adjacent the top member 54 of the slider 52, while the bottom side 92 faces away from the top member 54 and toward the hooks 62, 64 of the legs 56, 58.

While many variations are possible, in this embodiment, the first separator plow 78 projects from the bottom side 92 of the first foot 88. As such, the first separator plow 78 faces away from the top member 54 of the slider 52 and in a direction toward the hooks 62, 64 of the legs 56, 58.

The separator plow 78, in this embodiment, generally has a triangle-shaped cross-section. As the slider 52 is moved in the opening direction 72 (FIG. 10), if the first separator plow 78 is correctly and operably positioned between the male track 36 and female track 38, the narrow end 79 (FIGS. 6 & 7) of the separator plow 78 will be the leading edge to engage the male track 36 and female track 38, while the wider portion 81 (FIGS. 6 & 7) of the triangle-shaped separator plow 78 will be the trailing portion of the plow 78 to pass between the tracks 36, 38.

As mentioned previously, the first tang 74 is deflectable. Compare FIGS. 4 and 6 to FIGS. 5 and 7. FIGS. 4 and 6 show the slider 52 in a fully resting state, when no external force is being applied to it. The first tang 74 is projecting laterally from a remaining portion of the slider 52. The separator plow 78 is in a position outside of the tracks 36, 38.

In FIGS. 5 and 7, the first tang 76 has been moved due to an external force being applied. For example, a person's fingers can be used to squeeze the first leg 56 and second leg 58 toward each other and move or deflect the first tang 74 in a direction toward the remaining portion of the first leg 56, toward the remaining portion of the slider 52, into the volume 60, and toward the second leg 58. In this position, the first separator plow 78 is positioned to be inside of the volume 60. When properly positioned on the zipper closure 14, the first separator plow 78 can be positioned between the interlocked male track 36 and female track 38 by pushing the first tang 74 into the volume 60 in the vicinity of the notch 40 on the zipper closure 14. When the first separator plow 78 is positioned at this location, the slider 52 can be then be moved in the opening direction 72 along the zipper closure 14 to unlock the zipper closure 14 by releasing the engagement between the male track 36 and female track 38.

Referring now to FIGS. 1 and 10, the slider 52 can be used in a method of operating a zippered bag having an openable and recloseable mouth. The method includes providing a zippered bag, such as plastic bag 12. The plastic bag 12 can have the features, as previously described, including first and second panels 18, 20, joined to each other; the recloseable zipper closure 14 with male and female tracks 36, 38 for interlocking and unlocking; the zipper closure 14 including notch 40; and slider 52 located on the zipper closure 14. The method can include a step of opening the mouth 32 by moving the slider 52 to the notch 40. Next, there is a step of squeezing the spaced legs 56, 58 inwardly toward each other to position the separator plow 78 on the first leg 56 between the male track 36 and female track 38. This will typically include moving the separator plow 78 from a position laterally outside of the internal volume 60 to a position within the volume 60 between the legs 56, 58. The notch 40 allows the plow 78 to be positioned between the tracks 36, 38. The method also includes while the plow 78 is between the male track 36 and female track 38, moving the slider 52 in the opening direction 72 along the zipper closure 14 to result in separation of the interlocking profiles 36, 38.

The step of squeezing the spaced legs 56, 58 can include a step of moving the flexible tang 74 projecting laterally away from the remaining portion of the first leg 56 and a remaining portion of the slider 52 to position the separator plow 78 between the male track 36 and female track 38.

To close the mouth 32, the slider 52 is moved along the closing direction 70. The internal surfaces 66, 68 will operate to press the male track 36 and female track 38 to engage and interlock together. The separator plow 78 may or may not return to its original, non-engaging position upon release of the force or pressure by the user's fingers. However, it is not necessary or desirable to push in on the first tang 74 to close the mouth 32, as the separator plow 78 has no effect on the closing of the zipper closure 14.

C. Example Embodiment of FIGS. 11-19

Another embodiment of a child resistant slider closure system is shown in FIGS. 11 to 19 at 100. The system 100 uses a second embodiment of slider 16 at 102. Where the slider 102 includes common features of the slider 52, the same reference numbers are used. As such, a description of these common features is not repeated here again with respect to slider 102, but incorporated herein by reference. The description of the differences between slider 102 and slider 52 is described below.

In this embodiment, the slider 102 has additional child resistant features to inhibit a child from being able to easily unlock the zipper closure 14. In particular, the slider 102 further includes a second tang 104. The second tang 104 projects laterally away from a remaining portion of the second leg 58 and a remaining portion of the slider 102. The second tang 104 has a second separator plow 106 on a portion thereof.

Figure 13:
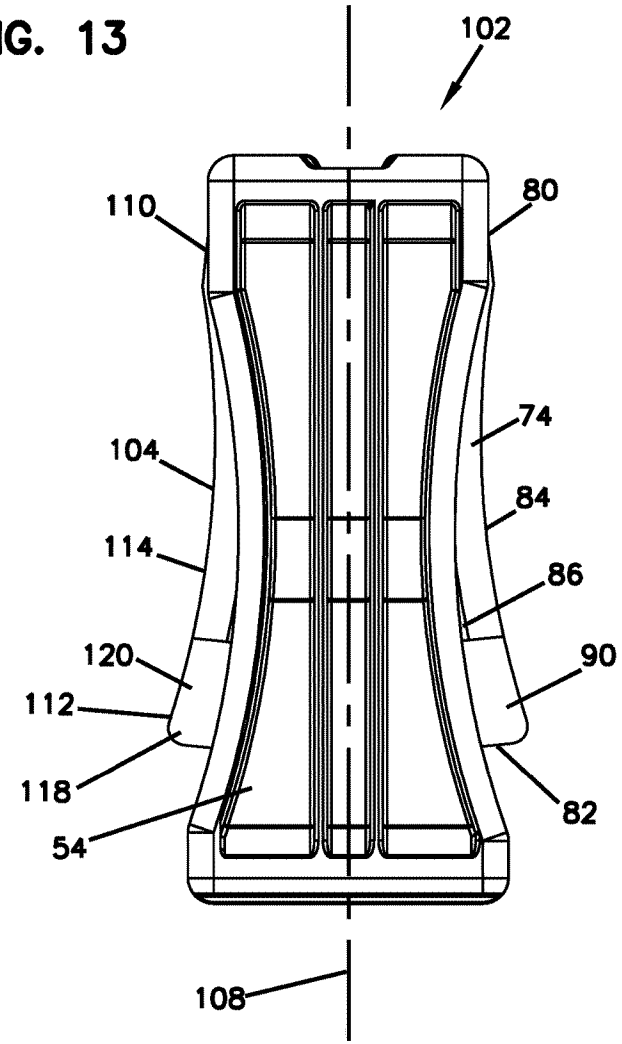
FIG. 13 is a top view of the slider used in the system of FIG. 11 and showing two deflecting tangs projecting laterally away from a remaining portion of the slider.

In FIG. 13, the central longitudinal axis 108 can be seen along a plane bisecting the slider 102 between the legs 56, 58. Each of the first tang 74 and second tang 104 is shown in its resting state, without external force applied to it, such that the tangs, 74, 104 project away or are angled from a remaining portion of the slider 102. That is, each of the tangs 74, 104 is contained within a respective plane that is not parallel and is angled at a non-zero angle relative to a plane containing the longitudinal axis 108.

Figure 16:
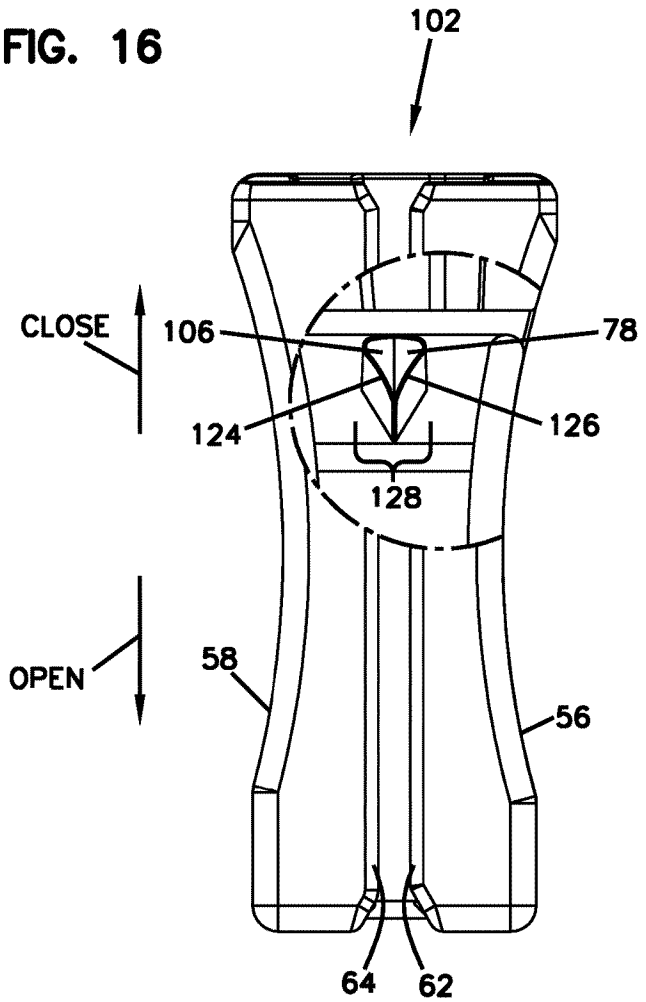
FIG. 16 is a bottom view of the slider of FIG. 14 with a portion broken away to show better views of the inwardly deflected tangs.
Figure 15:
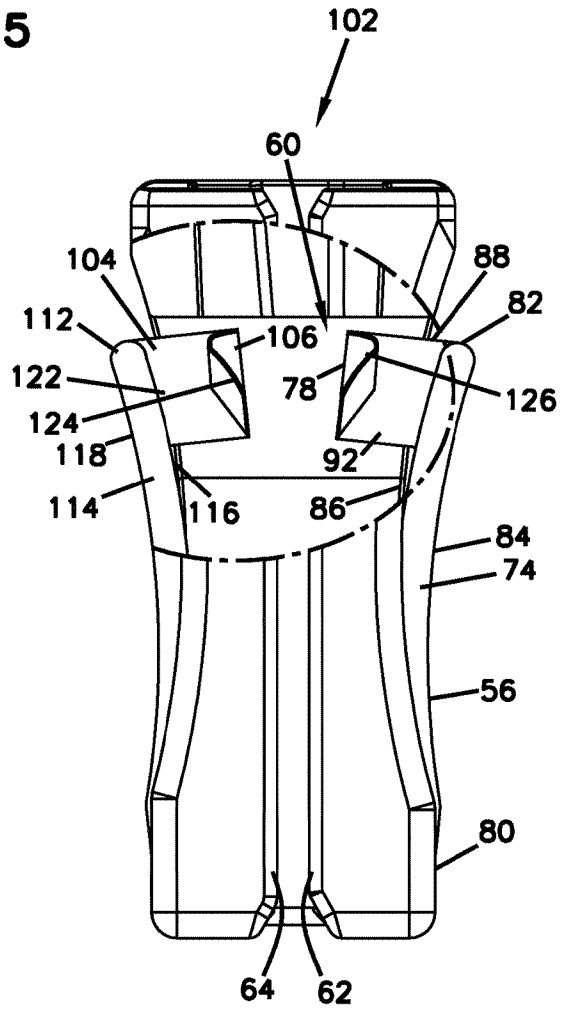
FIG. 15 is a bottom view of the slider of FIG. 13, with portions broken away to better illustrate the deflecting tangs.
Figure 17:
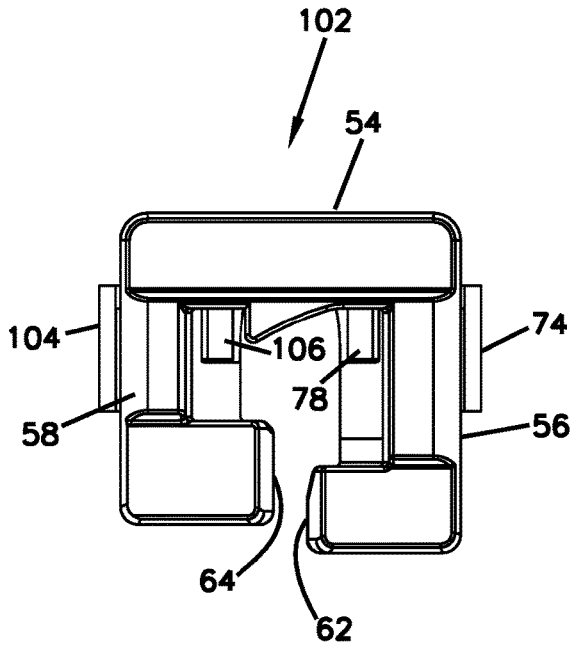
FIG. 17 is an end view of the slider of FIG. 13.
Figure 18:
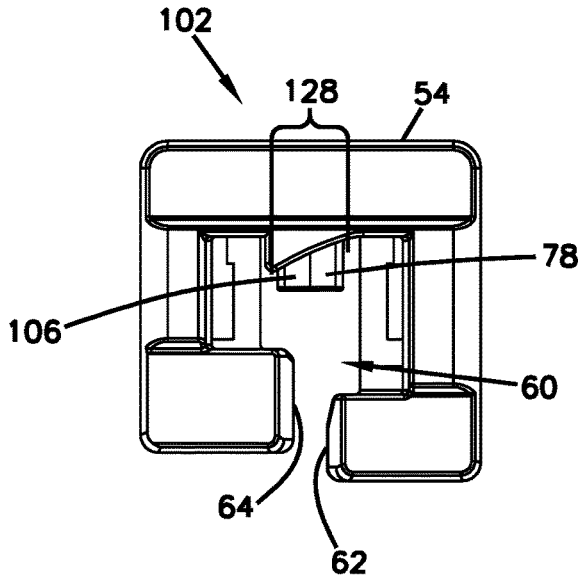
FIG. 18 is an end view of the slider of FIG. 14.

The second tang 104 has a fixed end 110. The fixed end 110 is secured to a remaining portion of the second leg 58 of the slider 102. The second tang 104 has a free, deflectable end 112 opposite of the fixed end 110. The free, deflectable end 112 has the second separator plow 106 (FIGS. 15,16).

The second tang 104 includes an external side 114 facing away from a remaining portion of the slider 102 and an opposite internal side 116 facing the volume 60 and the first leg 56. Extending from the internal side 116 is a foot 118. The foot 118 extends from the free end 112 and from the internal side 116 to project into the volume 60 (FIGS. 15,16).

The foot 118 has a top side 120 (FIG. 13) facing the top member 54 and an opposite bottom side 122 (FIG. 15) facing the hooks 62, 64 of the legs 56, 58.

In this embodiment, the second separator plow 106 extends from the bottom side 122 of the foot 118 to project in a direction away from the top member 54 and toward the hooks 62, 64 of the legs 56, 58.

The second separator plow 106, in this embodiment, has the cross-sectional shape of a triangle 124. The size of the triangle 124 is a size that is not sufficiently large enough to, all by itself, be able to separate the male track 36 from the female track 38. Also in this embodiment, the first separator plow 78 has the cross-sectional shape of a triangle 126, which is not sufficiently large enough on its own to be able to separate the interlocked male track 36 and female track 38. Rather, in this embodiment, in order to separate the interlocked male track 36 and female track 38, both the first separator plow 78 and second separator plow 106 need to be adjacent each other. In many embodiments, the separator plows 78, 106 need to be both adjacent and against each other to form a single, integral plow 128 (FIG. 16). The integral plow 128 is of a sufficiently large size that it will cause separation of the male track 36 and female track 38 when correctly positioned with respect to the zipper closure 14 and moved in an opening direction 72. Stated another way, the adjacent first plow 78 and second plow 106 are shaped in an adjacent orientation to separate the male and female tracks 36, 38 as the slider 102 is moved in an opening direction along the zipper closure 14.

In operation and in reference to FIG. 19, the slider 102 can be used in a method of operating zippered plastic bag 12 to open the mouth 32. This is done by moving the slider 102 to the notch 40. Next, the legs 56 and 58 are squeezed inwardly toward each other to position the first separator plow 78 adjacent to the second separator plow 106 and result in integrated plow 128 and positioning the integrated plow 128 between the male track 36 and female track 38. Next, while the plow 128 is between the male and female tracks 36, 38, moving the slider 102 in the opening direction 72 along the zipper closure 14 to result in separation of the interlocking profiles 36, 38 by moving the integrated plow 128 between the tracks 36, 38.

The step of squeezing the spaced legs 56, 58 includes moving the flexible tangs 74, 104 toward each other so that the separator plows 78, 106 are moved from the deflected position into the internal volume 60 between the legs 56, 58 and with the triangles 124, 126 next to and engaging against each other.

To close the mouth 32, the slider 102 is moved in an opposite direction, in the closing direction 70. It is not necessary or desirable to squeeze the legs 56, 58 toward each other as the position of the plows 78, 106 has no effect on the closing operation.

The above represents example principles of this disclosure. Many embodiments can be made using these principles.

What is claimed is:

1. A child resistant slider zipper closure system comprising:

(a) a reclosable zipper closure with a male track and a female track having complementary profiles for interlocking and unlocking;

(b) a notch located in the male and female tracks; the notch being spaced a distance from an end of the zipper closure; and (c) a slider being slidably located on the zipper closure, the slider including a top member and a pair of spaced legs depending from the top member, the spaced legs defining an open volume therebetween to allow for passage of the tracks therethrough and with the legs straddling the tracks, and a central longitudinal axis contained within a plane bisecting the slider between the legs;

(i) at least a first leg of the spaced legs having a first tang with a fixed end secured to a remaining portion of the first leg and an opposite free deflectable end projecting laterally away from the central longitudinal axis and a remaining portion of the first leg; the first tang being oriented from the fixed end to a non-zero angle relative to the central longitudinal axis and deflectable from said non-zero angle towards said central longitudinal axis, the first tang having a first separator plow on a portion thereof;

(ii) the first tang being selectively moveable to locate the first plow in the open volume between the legs to separate the male and female tracks as the slider is moved in an opening direction along the zipper closure.

2. The slider zipper closure system of claim 1 further comprising internal surfaces spaced sufficiently close together to engage the male and female tracks into interlocking relationship as the slider is moved in a closing direction along the tracks.

3. The slider zipper closure system of claim 1 wherein the first plow is at the free end.

4. The slider zipper closure system of claim 1 wherein:

(a) a second leg of the spaced legs has a second tang projecting laterally away from a remaining portion of the second leg and a remaining portion of the slider; the second tang having a second separator plow on a portion thereof; and (b) both the first tang and second tang being selectively moveable to locate the first plow and second plow adjacent each other in the open volume between the legs, wherein the adjacent first plow and second plow are shaped in an adjacent orientation to separate the male and female tracks as the slider is moved in an opening direction along the zipper closure.

5. The slider zipper closure system of claim 4 wherein the second tang has a fixed end secured to a remaining portion of the second leg and a free deflectable end; the second plow being at the free end of the second tang.

6. The slider zipper closure system of claim 2 wherein the internal surfaces comprise internal surfaces of the legs.

7. A flexible package using the child resistant zipper closure system of claim 1, the package comprising:

(a) first and second panels each having a top forming a mouth, a bottom, and first and second opposing sides, the first and second panels being joined to each other along their respective bottoms, their respective first opposing sides, and their respective second opposing sides; and (b) wherein one of the tracks is in proximity to the top of the first panel, and the other of the tracks is in proximity to the top of the second panel.

8. A slider for a zipper closure having a male track and a female track with complementary profiles for interlocking and unlocking; the slider comprising:

(a) a top member and a pair of spaced legs depending from the top member; the spaced legs defining an open volume therebetween to allow for passage of the tracks therethrough and with the legs straddling the tracks, and a central longitudinal axis contained within a plane bisecting the slider between the legs;

(b) internal surfaces spaced sufficiently close together to press the profiles into interlocking relationship as the slider is moved in a closing direction along the zipper closure;

(c) at least a first tang extending from a first leg of the spaced legs and being spaced away from a remaining portion of the first leg and a remaining portion of the slider; the first tang having a fixed end secured to a remaining portion of the first leg and an opposite free deflectable end projecting laterally away from the central longitudinal axis and the remaining portion of the first leg; the first tang being oriented from the fixed end to a non-zero angle relative to the central longitudinal axis and deflectable from said non-zero angle towards said central longitudinal axis; the first tang being constructed and arranged to flex relative to the first leg about a pivot axis in a direction toward and away from the open volume;

(d) a first separator plow extending from the first tang and moving toward and away from open volume with flexing of the first tang; the first separator plow being selectively moveable into a position to be between the male track and female track and separate the interlocking profiles as the slider is moved in an opening direction along the zipper closure.

9. The slider of claim 8 wherein the first plow is at the free end.

10. The slider of claim 8 wherein:

(a) a second leg of the spaced legs has a second tang projecting laterally away from a remaining portion of the second leg and a remaining portion of the slider; the second tang having a second separator plow on a portion thereof; and (b) both the first tang and second tang being selectively moveable to locate the first plow and second plow adjacent each other into the open volume between the legs to separate the interlocking profiles as the slider is moved in an opening direction along the zipper closure.

11. The slider of claim 10 wherein both the first tang and second tang are selectively moveable to locate the first plow and second plow against each other into the open volume between the legs to separate the interlocking profiles as the slider is moved in an opening direction along the zipper closure.

12. The slider of claim 10 wherein the second tang has a fixed end secured to a remaining portion of the second leg and a free deflectable end; the second plow being at the free end of the second tang.

13. The slider according to claim 8 wherein the slider is molded as a single piece.

14. The slider of claim 8 wherein the internal surfaces comprise internal surfaces of the legs.

15. A method of operating a zippered bag having an openable and recloseable mouth; the method comprising:

(a) providing a zippered bag having first and second panels each having a top forming the mouth, a bottom, and first and second opposing sides; the first and second panels being joined to each other along their respective bottoms, their respective first opposing sides, and their respective second opposing sides; a recloseable zipper closure including a male track and female track with complementary profiles for interlocking and unlocking; one profile being in proximity to the top of the first panel, and the other profile being in proximity to the top of the second panel; the complementary profiles interlocking to close the mouth and unlocking to open the mouth; the zipper closure including a notch spaced a distance from the first side; a slider located on the zipper closure; the slider having a top member and a pair of spaced legs depending from the top member, the spaced legs defining an open volume therebetween to allow for passage of the tracks therethrough and with the legs straddling the tracks, and a central longitudinal axis contained within a plane bisecting the slider between the legs;

(i) at least a first leg of the spaced legs having a first tang with a fixed end secured to a remaining portion of the first leg and an opposite free deflectable end projecting laterally away from the central longitudinal axis and a remaining portion of the first leg; the first tang being oriented from the fixed end to a non-zero angle relative to the central longitudinal axis and deflectable from said non-zero angle towards said central longitudinal axis, the first tang having a first separator plow on a portion thereof;

(ii) the first tang being selectively moveable to locate the first plow in the open volume between the legs to separate the male and female tracks as the slider is moved in an opening direction along the zipper closure; and (b) opening the mouth by:

(i) moving the slider to the notch;

(ii) squeezing the spaced legs inwardly toward each other to position the separator plow on at least one of the legs between the male track and female track; and (iii) while the plow is between the male track and female track, moving the slider in an opening direction along the zipper closure to result in separation of the interlocking profiles.

16. The method of claim 15 wherein the step of squeezing the spaced legs includes moving the flexible tang projecting laterally away from a first of the legs and a remaining portion of the slider to position the separator plow between the male track and female track.

17. The method of claim 15 wherein the step of squeezing the spaced legs includes moving a pair of flexible tangs, each flexible tang having a separator plow, each flexible tang projecting laterally away from a respective one of the legs and a remaining portion of the slider, to position the separator plows between the male track and female track.

18. The method of claim 17 wherein the step of positioning the separator plows includes positioning the separator plows adjacent and against each other between the male track and female track.

* * * * *